US009474315B2

(12) United States Patent
Lee

(10) Patent No.: US 9,474,315 B2
(45) Date of Patent: Oct. 25, 2016

(54) VENTILATION CAP

(71) Applicant: Ryan Keun Lee, Los Angeles, CA (US)

(72) Inventor: Ryan Keun Lee, Los Angeles, CA (US)

( * ) Notice: Subject to any disclaimer, the term of this patent is extended or adjusted under 35 U.S.C. 154(b) by 0 days.

(21) Appl. No.: 14/733,441

(22) Filed: Jun. 8, 2015

(65) Prior Publication Data

US 2016/0157542 A1 Jun. 9, 2016

(30) Foreign Application Priority Data

Dec. 5, 2014 (KR) ..... 10-2014-0173691

(51) Int. Cl.

| | |
|---|---|
| ***A42C 5/04*** | (2006.01) |
| ***A42B 3/28*** | (2006.01) |
| ***A42B 1/00*** | (2006.01) |
| ***A42B 1/06*** | (2006.01) |

(52) U.S. Cl.

CPC ..... *A42B 1/008* (2013.01); *A42B 1/062* (2013.01); *A42B 3/286* (2013.01); *A42C 5/04* (2013.01)

(58) Field of Classification Search

CPC ..... A42C 5/04; A42B 1/008; A42B 3/286; A42B 3/285; A42B 1/004; A42B 3/28; A61M 16/0066; A61M 16/1075; A61M 2209/088; F24F 2221/38; F24F 7/007

See application file for complete search history.

(56) References Cited

U.S. PATENT DOCUMENTS

| | | | | | |
|---|---|---|---|---|---|
| 4,680,815 | A * | 7/1987 | Hirsch | A42C 5/04 | 2/171.3 |
| 4,893,356 | A * | 1/1990 | Waters | A42B 1/008 | 2/171.3 |
| 5,085,231 | A * | 2/1992 | Johnson | A24F 47/00 | 131/329 |
| 5,425,620 | A * | 6/1995 | Stroud | A42B 1/008 | 2/171.3 |
| 6,032,291 | A * | 3/2000 | Asenguah | A42B 1/008 | 2/171.3 |
| 6,598,236 | B1 * | 7/2003 | Gantt | A42B 1/008 | 132/53 |
| 6,760,925 | B1 * | 7/2004 | Maxwell | A42B 3/285 | 2/171.3 |
| 7,143,451 | B2 * | 12/2006 | Lundgren | A42C 5/04 | 2/171.3 |
| 7,290,292 | B1 * | 11/2007 | Nellon | A42C 5/04 | 2/171.3 |
| 7,331,064 | B1 * | 2/2008 | Quintal | A42B 1/008 | 2/171.3 |
| D612,133 | S * | 3/2010 | Hermann, II | D2/866 | |
| 7,866,958 | B2 * | 1/2011 | Patel | F04B 17/006 | 417/234 |
| 7,921,473 | B1 * | 4/2011 | Winters | A42B 3/286 | 2/171.3 |
| 8,480,365 | B2 * | 7/2013 | Ochoa | F04D 25/0673 | 416/146 R |
| 8,590,062 | B2 * | 11/2013 | Gupta | A42B 1/008 | 2/171.2 |
| 8,757,831 | B2 * | 6/2014 | Waters | A42B 1/244 | 200/566 |
| 9,161,587 | B2 * | 10/2015 | Green | A42B 3/286 | |
| 2007/0061946 | A1 * | 3/2007 | Webb | A42B 3/286 | 2/410 |
| 2008/0222777 | A1 * | 9/2008 | Schneider | A42B 1/24 | 2/209.13 |
| 2013/0142656 | A1 * | 6/2013 | Hamilton | F04D 15/00 | 416/205 |
| 2015/0033445 | A1 * | 2/2015 | Warner | A42B 1/248 | 2/209.13 |

* cited by examiner

*Primary Examiner* — Bobby Muromoto, Jr.
(74) *Attorney, Agent, or Firm* — Robert E. Bushnell, Esq.

(57) ABSTRACT

Disclosed is a cap which may be mainly used for the purpose of sports or leisure activities, for example, golf, mountaineering, and the like, and in particular the cap is provided with a built-in ventilation unit which may include a ventilation unit for ventilating the air inside the cap and may be easily used thanks to a dual-cap structure with a solar cells part installed on a visor of the cap wherein an inner cap part of the dual-cap structure contacting a head portion of a user wearing the cap and an outer cap part of the dual-cap structure may be detachable from the inner cap part while facilitating easier washing and caring. An electric fan is installed in the inner cap part, sucking air from outside into the cap while effectively discharging air inside the cap to the outside.

6 Claims, 4 Drawing Sheets

VENTILATION CAP

CLAIM OF PRIORITY

This application claims the priority to and all the benefits accruing under 35 U.S.C. §119 of Korean Patent Application No. 10-2014-0173691, filed on Dec. 5, 2014, with the Korean Intellectual Property Office (KIPO), the disclosure of which is incorporated herein in its entirety by reference.

BACKGROUND OF THE INVENTION

1. Field of Disclosure

The present invention relates to a cap which may be mainly used for the purpose of sports or leisure activities, for example, golf, mountaineering, and the like, and in particular the cap is provided with a built-in ventilation unit which may include a ventilation unit for ventilating the air inside the cap and may be easily and effectively used thanks to a dual-cap structure with a solar cells part installed at a visor of the cap, the dual-cap structure having an inner cap part contacting a head of a user wearing the cap and an outer cap part that may be detachable from the inner cap part to facilitate easier washing and caring.

2. Description of the Related Art

A cap may be a part of fashion and is configured to protect a user's head skin and face from ultraviolet ray by blocking sunshine, and it may be used to block any wind or coldness.

For the above reasons, the cap has been widely used for sports and leisure activities, for example, fishing, golf, etc. The cap is generally manufactured to satisfy its functional operation based on various purposes. For example, a fabric capable of substantially evaporating sweat during exercise while effectively venting the air from the outside is selected and used to make the cap, and the fabric may have different structures. The material and structure of the raw fabric, however, may have limitations.

A conventional cap disclosed in the Korean utility patent application registration number KR 20-0297340 is configured to provide cool wind to a user's head portion by attaching on a convex side of the cap, an electric fan operated by receiving an electric power from a solar cells panel.

According to the above mentioned conventional cap, a cool wearing state may be obtained in such a way to provide cool external air to the head portion of the user wearing the cap by supplying external air to the inside of the cap; however the air supplied to the inside of the cap may not be easily discharged to the outside, so the functions of the above conventional cap are not effective, and it is hard to wash the cap.

SUMMARY OF THE INVENTION

Accordingly, the present invention is made in an effort to overcome the above problems. It is an object of the present invention to provide a cap with a built-in ventilation unit which makes it possible to suck air into the cap and effectively discharge the air inside the cap to the outside by providing a dual-cap structure including an outer cap part and an inner cap part and by installing an electric fan at the inner cap part, for which the present invention may be well applied to sports, for example, golf, etc.

To achieve the above objects, a cap is provided with a built-in ventilation unit which may include a dual-cap structure formed of an inner cap part and an outer cap part to which the inner cap part is attached, and a solar cells part attached to a cap visor of the outer cap part to supply an electric power, wherein the outer cap part includes an air suction port formed along a region surrounding a top center of the outer cap part, and an air discharge port discharging the air inside the cap to the outside is spaced apart by a predetermined interval from the air suction port, and there is provided a first attachment means attaching the outer cap part to the inner cap part, and a third attachment means attaching the solar cells part to an inner side of the cap visor, wherein the inner cap part may include a first inner body formed of a motor positioned at a lower side of a top center of the first inner body, a rotation blade rotated by the motor to suck external air into the cap, a ventilation unit with a motor driving unit, a suction port configured to suck air from the air suction port of the outer cap part, and a second attachment means attaching to the first attachment means of the outer cap part; a second inner body which includes an electric cable holder closely contacting with an inner side of the outer cap part and configured to let an electric cable of the ventilation extend through the cap to the outside; and an air ventilation unit which is installed at the second inner body and is spaced apart from the first inner body and the air ventilation unit includes a plurality of air ventilation holes closely contact a head of a user wearing the cap.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
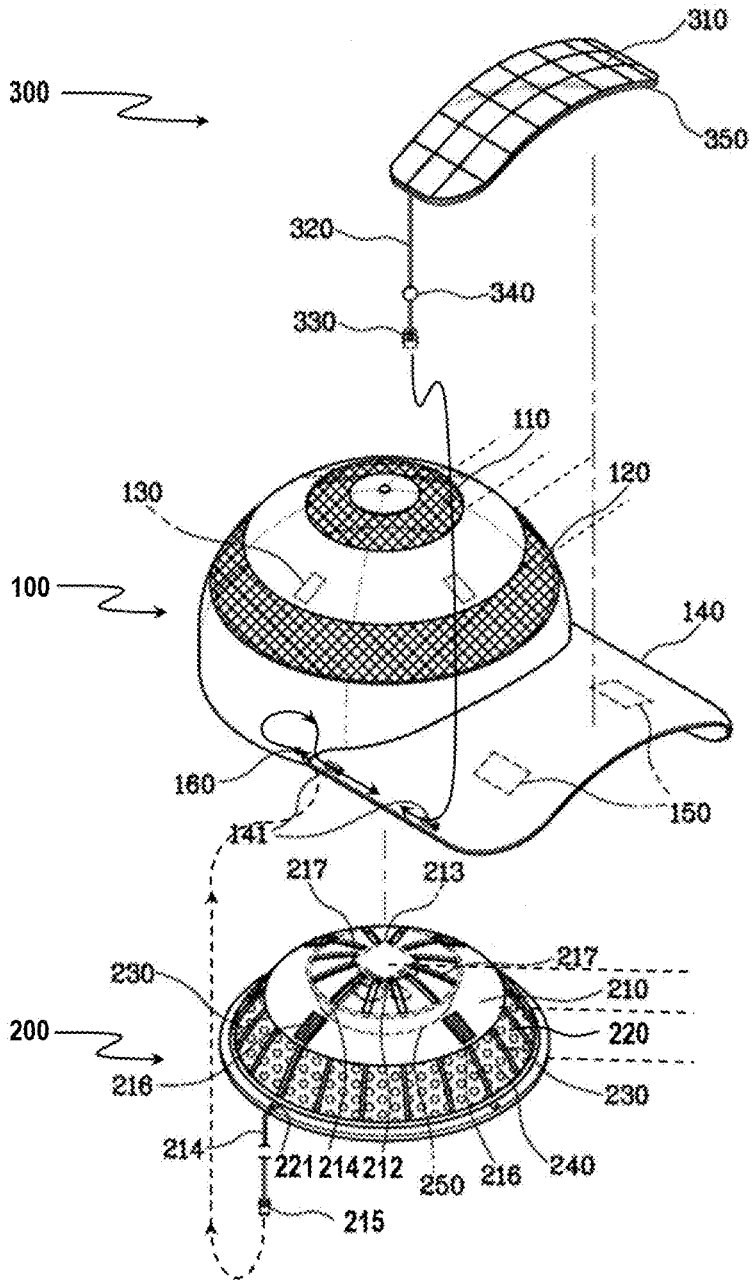
FIG. 1 is a separated perspective view illustrating a structure of a cap with a built-in ventilation unit according to the present invention.
Figure 2:
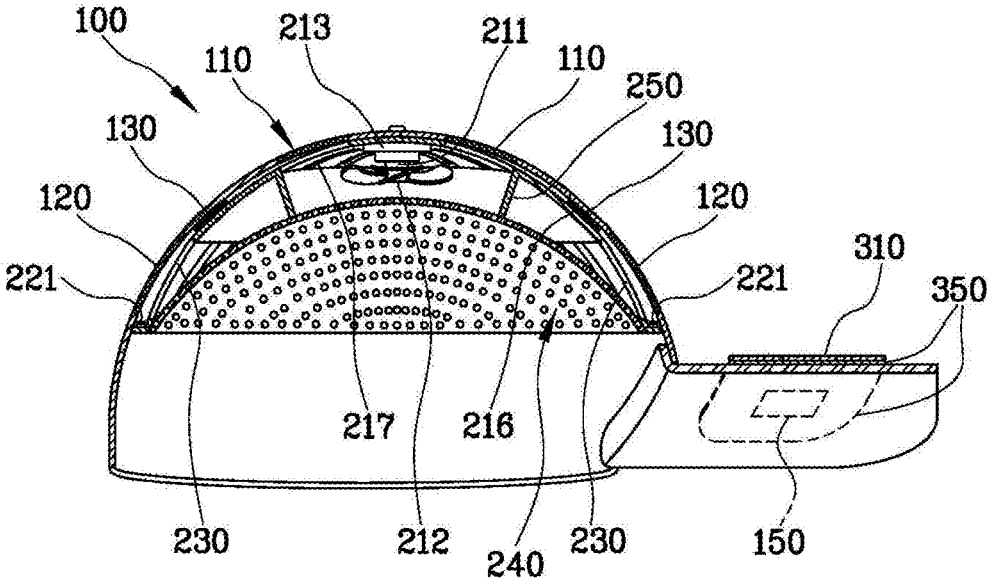
FIG. 2 is a cross sectional view illustrating a structure of a cap with a built-in ventilation unit according to the present invention.

The present invention is directed to a dual-cap structure which may include a ventilation unit inside of the dual-cap structure, thus effectively sucking external air into the interior of the cap, while being configured to effectively discharge the internal air to the outside, thus securing easier washing and maintenance.

The configuration and operation of the cap with a built-in ventilation unit according to the present invention will be described with reference to the accompanying drawings.

The present invention may be directed to a dual-cap structure which may include an inner cap part 200, and an outer cap part 100 to which the inner cap part 200 is attached, and there is further provided a solar cells part 300 attached to a cap visor 140 of the outer cap part 100 and configured to supply an electric power.

The outer cap part 100 may include an air suction port 110 formed to surround a top center of the outer cap part 100 and spaced apart by a predetermined interval from the air suction port 110, an air discharge part 120 discharging air to the outside, and a first attachment means 130 provided at an inner side of the outer cap part 100 to attach the outer cap part 100 to the inner cap part 200, and the cap visor 140 is formed in a structure having an inner side to which a metallic plate 150 is provided to attach the solar cells part 300.

The inner cap part 200 may include a first inner body 210 and a second inner body 220. The first inner body 210 includes a motor 211 at a lower side of the center of the first inner body 210, a rotation blade 212 rotated by the motor 211 to suck external air into an interior of the cap, a ventilation unit with a motor driving unit 213, and a suction port 217 configured to suck air from the air suction port 110 of the outer cap part 100. A second attachment means 216 is provided to attach the first attachment means 130 of the outer cap part 100, wherein the first inner body 210 is formed to surround the rotation blade 212 and includes a guide part 250 configured to guide the air inputted from the suction port 217 to the bottom side, a second inner body 220 which may include an electric cable holder 221 connected by a plurality of support members 230 to the first inner body 210 and closely contacting the inner side of the outer cap part 100 for thereby letting the electric cables of the ventilation unit extend to the outside, and an air ventilation port 240 which is installed at the second inner body 220 and is spaced apart from the first inner body 210 of the top and closely contacting the user's head and includes a plurality of air ventilation holes.

The cap with a built-in ventilation unit according to the present invention is characterized in providing an air ventilation unit inside the cap to suck external air into the interior of the cap and discharge the internal air to the outside.

The present invention may be formed in a dual-cap structure including an outer cap part 100 and an inner cap part 200 which includes an air ventilation unit.

The air suction port 110 of the outer cap part 100 is formed around the ventilation unit of the inner cap part 200; the ventilation unit is provided at the lower side of the inner cap part 200.

The first attachment means 130 provided at the inner surface of the outer cap part 100 and the second attachment means 216 provided at the top of the inner cap part 200 are Velcro fasteners.

A metallic plate 150 provided inside of the cap visor 140 of the outer cap part 100 is a member for attaching the solar cells part 300.

The solar cells part 300 may include solar cells 310 converting sun light to an electric power, a rubber magnet 350 at the lower sides of the solar cells 310, an electric cable 320 supplying an electric power from the solar cells 310, a jack 330 as a terminal member connecting to a plug 215 connected to the ventilation unit, and a switch 340.

An electric cable hole 160 may be formed at a bottom side of the outer cap part 100 for letting the electric cable 214 of a motor driving unit 213 extend to the outside, and at least one holder 141 provided along a side end of the cap visor 140 to hold the electric cable 214.

The inner cap part 200 may include a first inner body 210 with a ventilation unit, and a second inner body 220 which closely contacts with the outer cap part 100.

The first inner body 210 and the second inner body 220 are connected by a plurality of support members 230 and are configured in a communicative structure surrounding the first inner body 210, and the air ventilation port 240 is included in the second inner body 220 and spaced apart from the first inner body 210, the air ventilation port 240 is formed as a mesh structure with a plurality of air ventilation holes.

The ventilation unit of the first inner body 210 may be installed at an inner side of the top center of the first inner body 210 and may include a motor 211, a rotation blade 212 and a motor driving unit 213. The motor driving unit 213 may include a battery which is a storage member storing electric power generated from the solar cells 310, and the electric cable 214 receiving the electric power extends through the electric holder 221 at the second inner body 220 to the outer cap part 100 and may include a plug 215 which is coupled to the jack 330 of the solar cells part 300.

A suction port 217 is formed around the ventilation unit. A guide part 250 surrounds the ventilation unit and a lower outer side of the suction port 217.

The guide part 250 is a member receiving the air from the suction port 217 with the aid of the rotation of the rotation blade 212 and guiding the air to the lower side and may be formed in a structure in which the lower side of the guide part 250 is formed as a through hole having a side wall extending from the first inner body 210 to the lower side.

The Velcro fastener 216 which is a second attachment means 216 attached to the Velcro fastener 130 of the outer cap part 100 is formed at the top of the first inner body 210.

The functions and operations of the cap with a built-in ventilation unit according to the present invention will be described.

The electric power generated from the solar cells 310 provided at the cap visor 140 is supplied through the electric cables 320 and 214 to the motor driving unit 23 which operates the motor 211 based on a switching selection of the switch 340 to rotate the rotation blade 212.

Since the rotation blade 212 is rotated inside the guide part 250, inflow pressure occurs at the top of the suction port 217, and air is sucked through the air suction port 110 of the outer cap part 100, inputted through the suction port 217 into the guide part 250, and further into the inner side of the air ventilation port 240 facing the head of the user wearing the cap.

Therefore, the air in the air ventilation port 240 is then discharged through the sir discharge port 120 to the outside.

Figure 3:
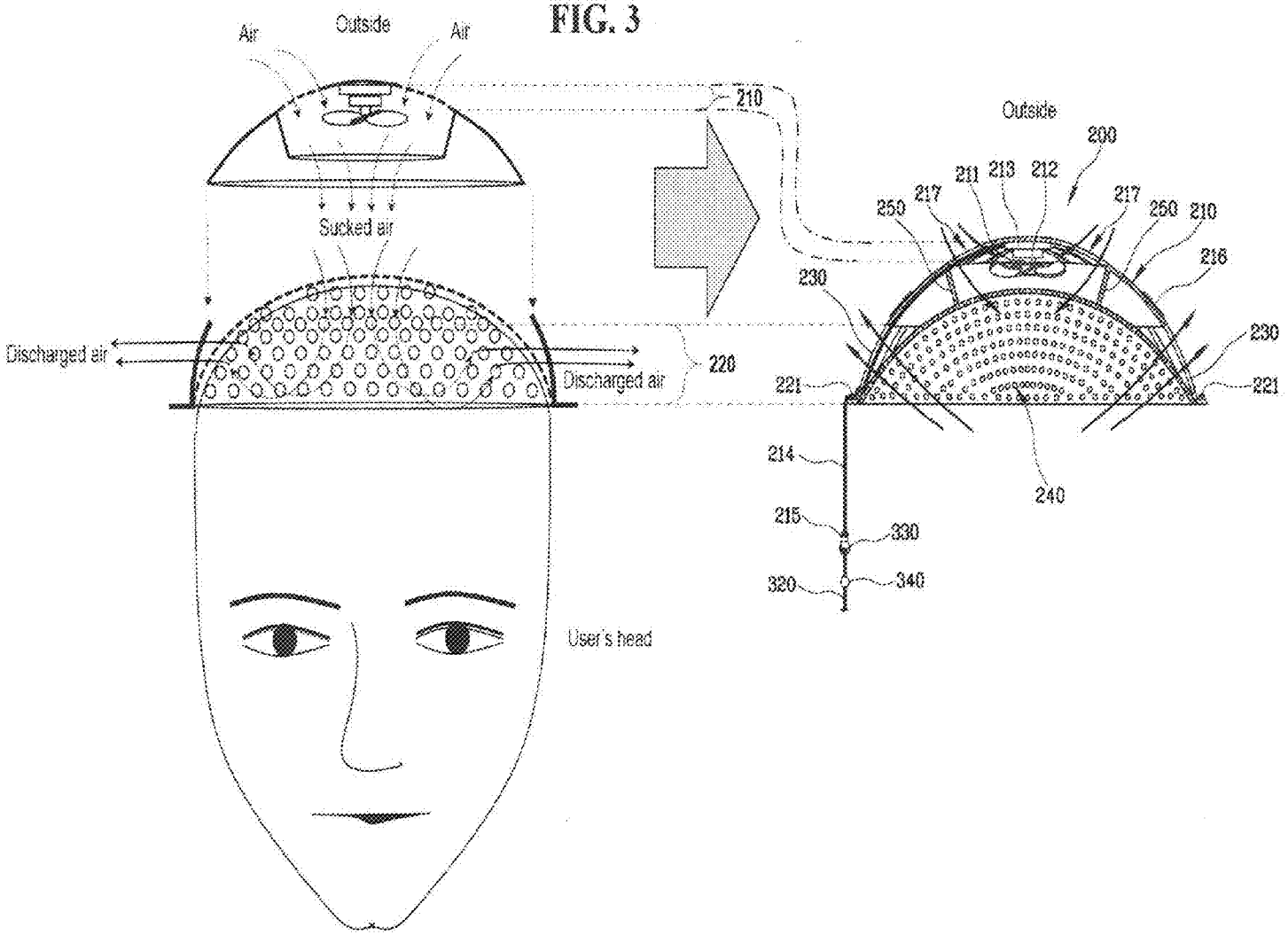
FIG. 3 is a view illustrating an air flow of a cap with a built-in ventilation unit according to the present invention.
Figure 4:
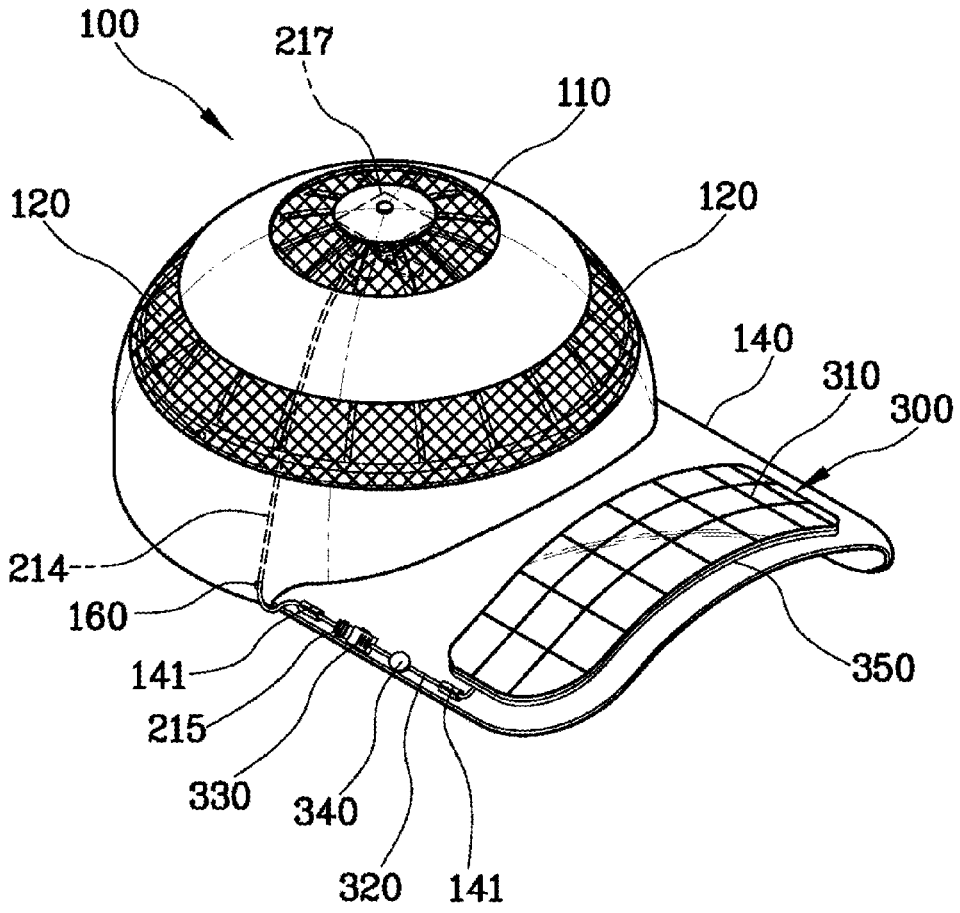
FIG. 4 is a view illustrating an engaged state of a cap with a built-in ventilation unit according to the present invention.

FIG. 3 is a view illustrating the flow of air.

The user may select the switch 340 to rotate the rotation blade 212, thus venting the air inside of the cap.

The user may separate the jack 330 of the solar cells part 300 from the plug 215, and the electric cable 320 from the holder 141, and the solar cells 310 from the cap visor 140. The user may also separate the outer cap part 200 from the inner cap part 100 by pulling the inner cap part 200 downward and separating the Velcro fasteners 130 and 216.

After performing the separations procedures in the above way, the outer cap part 100 may be washed or the ventilation of the inner cap part 200 may be repaired, if necessary.

What is claimed is:

1. A cap with a built-in ventilation means, comprising:

a dual-cap structure formed of an inner cap part 200 and an outer cap part 100 attached to the inner cap part 200; and a solar cells part 300 attached to a cap visor 140 of the outer cap part 100 to supply an electric power, wherein the outer cap part 100 includes:

an air suction port 110 surrounding a top center of the outer cap part 100, sucking air from outside to inside of the cap;

an air discharge port 120 spaced apart by a predetermined interval from the air suction port 110, discharging air inside the cap to outside;

a first attachment means 130 attaching the outer cap part 110 to the inner cap part 200; and a third attachment means 150 attaching the solar cells part 300 to an inner side of the cap visor 140, the inner cap part 200 includes:

a first inner body 210 includes:

a motor 211 positioned at a lower side of a top center of the first inner body 210, a rotation blade 212 rotated by the motor 211 to suck air from outside to inside of the cap, a ventilation unit with a motor driving unit 213, a suction port 217 configured to suck air from the air suction port 110 of the outer cap part 100, and a second attachment means 216 attaching the first attachment means 130 of the outer cap part 100;

a second inner body 220 includes:

an electric cable holder 221 closely contacting the outer cap part 100 and configured to let an electric cable of the ventilation unit extend to outside; and an air ventilation port 240 installed at the second inner body 220 and spaced apart from the first inner body 210, including a plurality of air ventilation holes closely contacting a head of a user wearing the cap.

2. The cap of claim 1, wherein the first inner body 210 includes a guide part surrounding the rotation blade 212 having a lower side formed as a through hole so that a side wall of the guide part 250 extends from the first inner body 210 to the lower side, guiding air from the suction port 217 to the lower side of the guide part 250.

3. The cap of claim 1, wherein the second inner body 220 is connected by a plurality of support members 230 to the first inner body 210, forming a discharge space of air.

4. The cap of claim 1, wherein the first attachment means 130 provided at the inner side of the outer cap part 100 and the second attachment means 216 provided at the top of the inner cap part 200 are Velcro fasteners.

5. The cap of claim 1, wherein the solar cells part 300 includes:

solar cells 310 converting sun light to electric power, a rubber magnet 350 disposed at the solar cells 310, an electric cable 320 supplying the electric power from the solar cells 310, a jack 330 connecting to a plug 215 connected to the ventilation unit to operate the cap, and a switch 340, wherein the third attachment means 150 of the solar cells part 300 provided at the cap visor 140 of the outer cap part 100 is configured by stacking a metallic plate 150 inside the cap visor 140.

6. The cap of claim 1, wherein an electric cable hole 160 is formed at a bottom of one side of the outer cap part 100 for the electric cable 214 of a motor driving unit 213 to extend to the outside, and at least one holder 141 may be provided along an end of one side of the cap visor 140 for holding the electric cable 214.

* * * * *